US009698524B1

(12) United States Patent
Morgan et al.

(10) Patent No.: US 9,698,524 B1
(45) Date of Patent: Jul. 4, 2017

(54) MAGNETIC, SELF-RETRACTING, AUTO-ALIGNING ELECTRICAL CONNECTOR

(71) Applicant: EMC Corporation, Hopkinton, MA (US)

(72) Inventors: Dale T. Morgan, Waltham, MA (US); Sean P. O'Donnell, Poughkeepsie, NY (US); Jeremy Zorrilla De Los Santos, Whitinsville, MA (US); Matthew Kielbasa, Milford, MA (US)

(73) Assignee: EMC IP HOLDING COMPANY LLC, Hopkinton, MA (US)

( * ) Notice: Subject to any disclaimer, the term of this patent is extended or adjusted under 35 U.S.C. 154(b) by 0 days.

(21) Appl. No.: 14/825,724

(22) Filed: Aug. 13, 2015

Related U.S. Application Data

(63) Continuation of application No. 13/731,520, filed on Dec. 31, 2012, now Pat. No. 9,160,102.

(51) Int. Cl.
*H01R 13/60* (2006.01)
*H01R 13/62* (2006.01)
*H01R 43/16* (2006.01)

(52) U.S. Cl.
CPC ..... *H01R 13/6205* (2013.01); *H01R 43/16* (2013.01)

(58) Field of Classification Search
CPC .... H01R 13/6205; H01R 43/16; H01R 11/30; H01J 23/10; H01J 25/50
USPC ..... 439/39
See application file for complete search history.

(56) References Cited

U.S. PATENT DOCUMENTS 3,363,214 A 1/1968 Wright
3,808,577 A 4/1974 Mathauser
3,843,904 A * 10/1974 Brown ..... H01J 23/10 313/157
3,855,498 A * 12/1974 MacMaster ..... H01J 23/10 313/157
3,984,725 A * 10/1976 Cook ..... H01J 23/10 313/157
3,987,333 A * 10/1976 Nakada ..... H01J 25/50 315/39.51
3,989,979 A * 11/1976 Konno ..... H01J 25/50 315/39.51

(Continued)

*Primary Examiner* — Jean F Duverne
(74) *Attorney, Agent, or Firm* — Krishnendu Gupta

(57) ABSTRACT

Embodiments of the present invention provide an apparatus, a system, and a method of manufacturer for a magnetic, self-retracting, auto-aligning electrical connector. The apparatus includes a first conductor and a first magnet configured to magnetically couple with a second magnet, wherein magnetic coupling causes a change in a magnetic field of a magnetically coupled combination of the first magnet and the second magnet and wherein the change in the magnetic field causes electrical coupling of the first conductor and a second conductor. The system includes a first connector comprising a first magnet and a first conductor and a second connector comprising a second magnet and a second conductor, wherein magnetic coupling causes a change in a magnetic field of a magnetically coupled combination of the first magnet and the second magnet and wherein the change in the magnetic field causes electrical coupling of the first conductor and the second conductor.

20 Claims, 10 Drawing Sheets

(56) References Cited

U.S. PATENT DOCUMENTS

| | | | | |
|---|---|---|---|---|
| 4,105,913 | A * | 8/1978 | Yamano | H01J 25/587<br>148/120 |
| 4,163,922 | A * | 8/1979 | Sakai | H01J 23/10<br>315/39.51 |
| 5,401,175 | A | 3/1995 | Guimond et al. | |
| 7,264,479 | B1 | 9/2007 | Lee | |
| 7,517,222 | B2 | 4/2009 | Rohrbach et al. | |
| 9,160,102 | B1 * | 10/2015 | Morgan | H01R 11/30 |

* cited by examiner

MAGNETIC, SELF-RETRACTING, AUTO-ALIGNING ELECTRICAL CONNECTOR

RELATED APPLICATION

This application is a Continuation of U.S. patent application Ser. No. 13/731,520 entitled "MAGNETIC, SELF-RETRACTING, AUTO-ALIGNING ELECTRICAL CONNECTOR" filed on Dec. 31, 2012.

A portion of the disclosure of this patent document may contain command formats and other computer language listings, all of which are subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

TECHNICAL FIELD

This application relates to electrical connectors, specifically magnetic, self-retracting, auto-aligning electrical connector.

BACKGROUND

Electronic devices typically use DC power supplied from a transformer connected to a conventional AC power supply. Conventional power connectors typically include a male connector with a male end that inserts into the female connector. Damage can occur to the conventional power connection in a number of ways. In one example, simply inserting the male connector into the female connector can cause damage. Damage can occur when the connectors are pulled apart by a non-axial force.

SUMMARY

Example embodiments of the present invention provide an apparatus, a system, and a method of manufacturer for a magnetic, self-retracting, auto-aligning electrical connector. The apparatus includes a first conductor and a first magnet configured to magnetically couple with a second magnet, wherein magnetic coupling of the first magnet and the second magnet causes a change in a magnetic field of a magnetically coupled combination of the first magnet and the second magnet and wherein the change in the magnetic field of the magnetically coupled combination of the first magnet and the second magnet causes electrical coupling of the first conductor and a second conductor. The system includes a first connector comprising a first magnet and a first conductor and a second connector comprising a second magnet and a second conductor, wherein magnetic coupling of the first connector and the second connector causes a change in a magnetic field of a magnetically coupled combination of the first magnet and the second magnet and wherein the change in the magnetic field of the magnetically coupled combination of the first magnet and the second magnet causes electrical coupling of the first conductor and the second conductor.

BRIEF DESCRIPTION OF THE DRAWINGS

The above and further advantages of the present invention may be better under stood by referring to the following description taken into conjunction with the accompanying drawings in which.

DETAILED DESCRIPTION

Traditional electrical connectors may be mechanically complex or fragile, require a specific orientation, lack a connection to electrical ground, have protruding electrical conductive elements risking electrical shorting or increased risk of electrical failure while connecting/disconnecting. However, example embodiments of the present invention overcome these and other deficiencies of traditional electrical connectors by providing a magnetic, self-retracting, auto-aligning electrical connector.

Figure 1A:
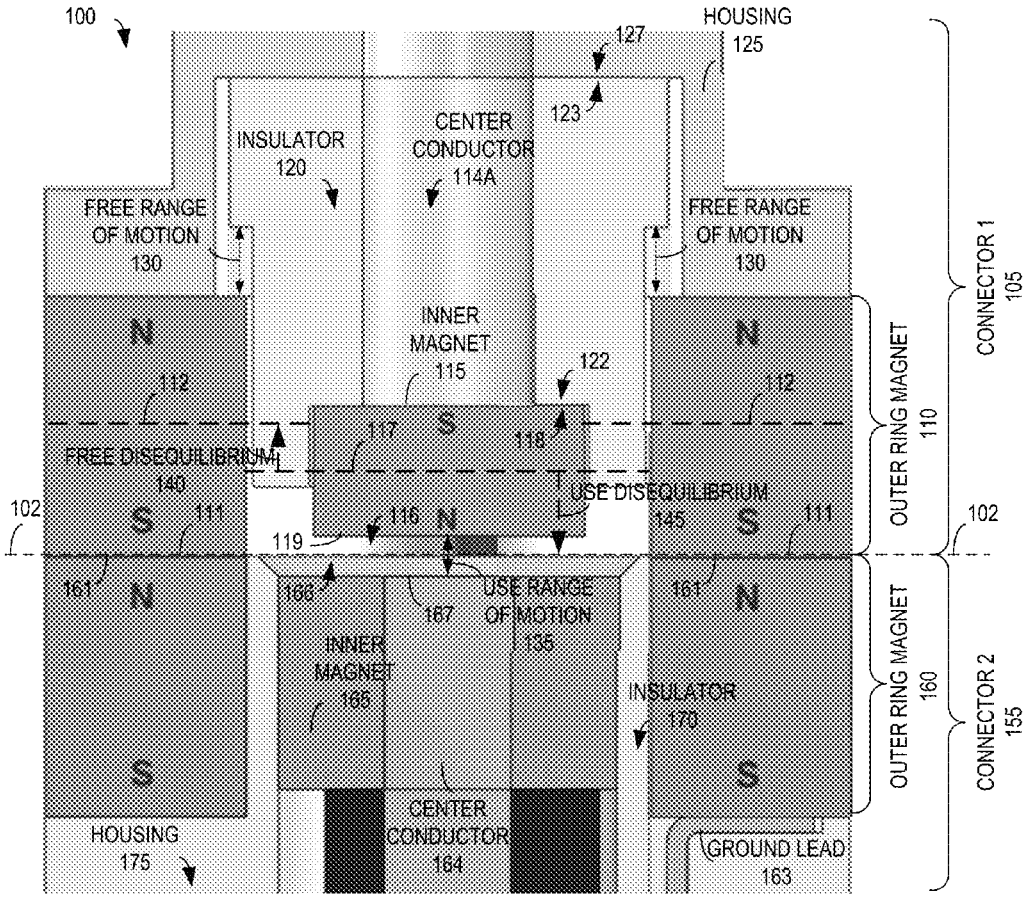
FIGS. 1A-1B are cross-sectional and isometric views, respectively, of a system comprising first magnetic, self-retracting, auto-aligning electrical connector and a second magnetic, self-retracting, auto-aligning electrical connector according to an example embodiment of the present invention.
Figure 1B:
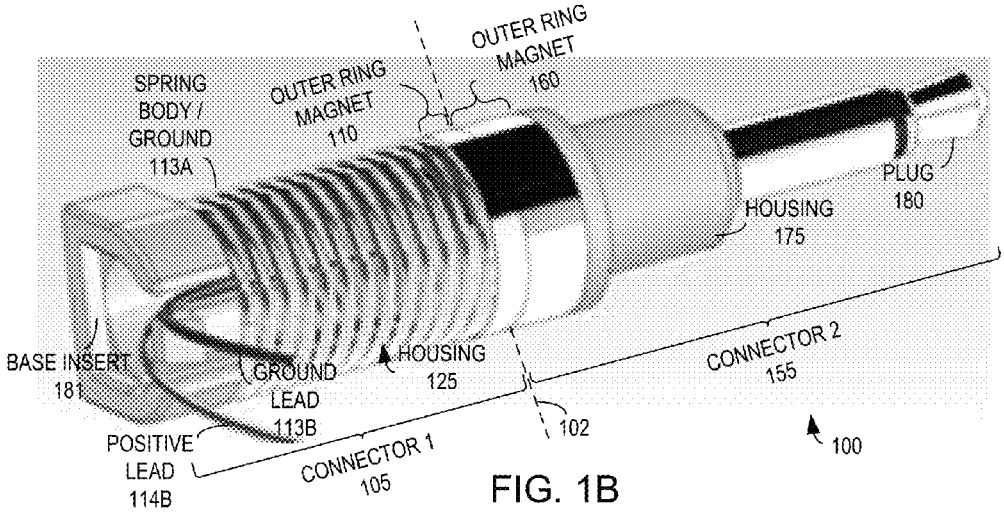
Figure 2A:
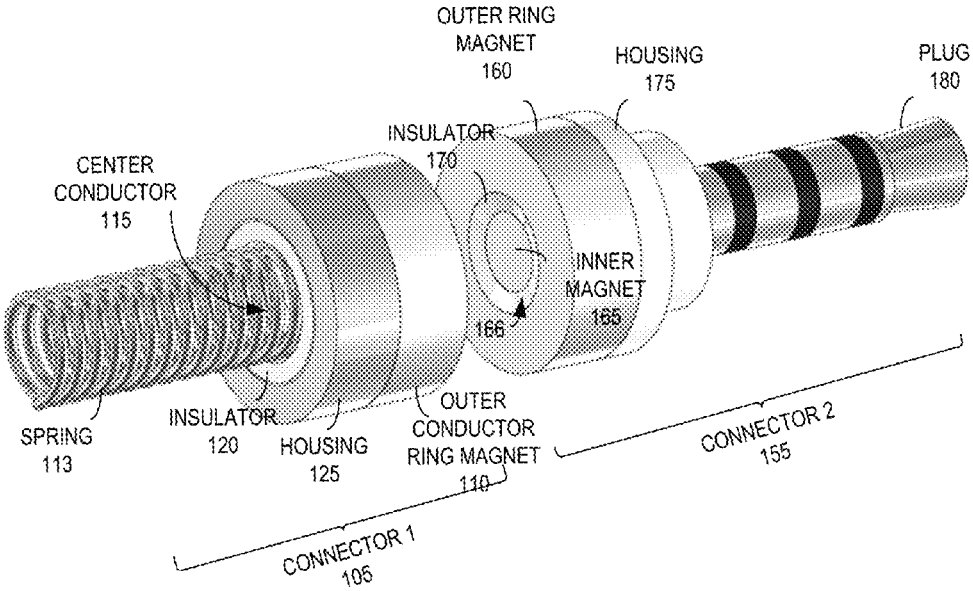
FIGS. 2A-2B are exploded isometric views of a system, comprising a first magnetic, self-retracting, auto-aligning electrical connector and a second magnetic, self-retracting, auto-aligning electrical connector, according to an example embodiment of the present invention.
Figure 2B:
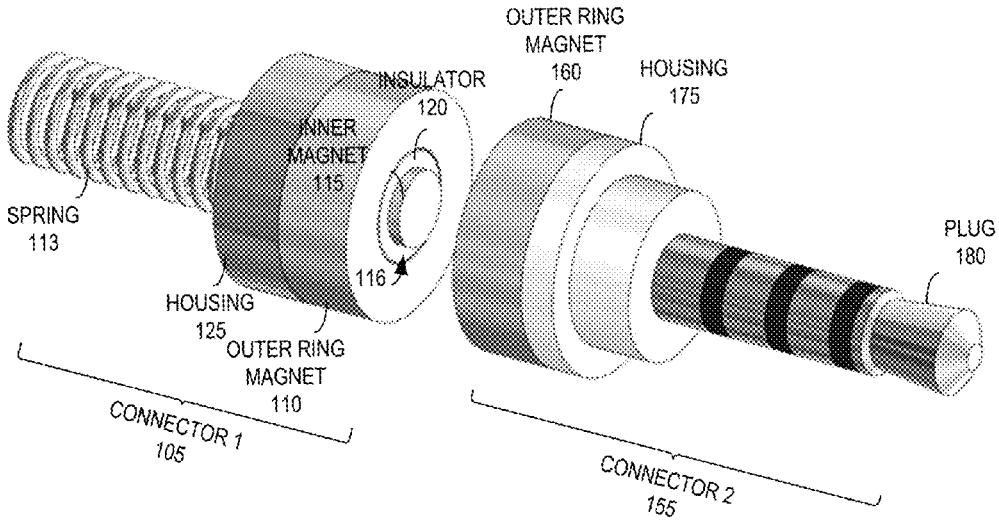

FIGS. 1A-1B are cross-sectional and isometric views, respectively, of a system 100 comprising first magnetic, self-retracting, auto-aligning electrical connector (Connector 1) 105 and a second magnetic, self-retracting, auto-aligning electrical connector (Connector 2) 155 according to an example embodiment of the present invention. FIGS. 2A-2B are exploded isometric views of a system comprising a first magnetic, self-retracting, auto-aligning electrical connector and a second magnetic, self-retracting, auto-aligning electrical connector according to an example embodiment of the present invention.

As illustrated in the example embodiments of FIGS. 1A-1B and 2A-2B, Connector 1 105 comprises a center conductor 114A and an outer ring magnet 110. The outer ring magnet 110 may be disposed coaxially circumferentially around the center conductor 114A. The center conductor 114A may be disposed substantially coaxially with the outer ring magnet 110. In a preferred embodiment, the out ring magnet 110 is configured to magnetically couple with an outer ring magnet 160 of Connector 2 155, as described below in greater detail.

As understood in the art, magnetic coupling of the outer ring magnets 110, 160 causes a change in a magnetic field of the magnetically coupled combination of the outer ring magnets 110, 160. As illustrated in FIG. 1A, in a disconnected state, magnetic equilibrium of the outer ring magnet 110 is at its midplane 112. However, magnetic coupling of the outer ring magnets 110, 160 causes a shift in the miplane 102 of the magnetic combination of the outer ring magnets 110, 160, thereby causing a change in the position of magnetic equilibrium for the system (i.e., the magnetic combination of the outer ring magnets 110, 160). It should be understood that the torroidal nature of the outer ring magnets 110, 160 tends to cause alignment if they come in close proximity; therefore, magnetic coupling of the outer ring magnets 110, 160 causes alignment of center conductors 114A, 164. In a preferred embodiment, the inner magnet 115 of Connector 1 105 and the outer ring magnet of Connector 2 155 have the same magnetic polarity; therefore, the opposing magnetic fields and floating nature of the inner magnet 115 of Connector 1 105 prevent these conductors from coming in contact and causing electrical misalignment.

According to an example embodiment of the present invention, as illustrated in FIGS. 1A-1B and 2A-2B, the change in the magnetic field of the magnetically coupled combination of the outer ring magnets 110, 160 may cause electrical coupling of the center conductor 114A and a center conductor 164 of Connector 2 155. It should be noted that the center conductor 164 may or may not be magnetic but that, if the center conductor 164 is magnetic, the magnetic field orientations are opposite one another. In certain embodiments, the center conductor 164 may be disposed substantially coaxially with the outer ring magnet 160. In other embodiments, the center conductor 114A of Connector 1 105 may comprise an inner magnet 115. Likewise, the center conductor 164 of Connector 2 155 may comprise an inner magnet 165, which may be an inner ring magnet disposed coaxially with the outer ring magnet 160. It should be understood that, in some embodiments, the center conductor 114A may be disposed coaxially at a diameter greater than the diameter of the first magnet 110. In other embodiments, the first magnet 110 may comprise a plurality of first magnets arranged radially coaxially with the first conductor 114A.

As illustrated in FIG. 1A, the inner magnet 115 of Connector 1 105 may have a polarity orientation opposite the polarity orientation of the outer ring magnet 110. Further, the inner magnet 115 of Connector 1 105 may have a height less than the height of the outer ring magnet 110. Accordingly, in a disconnected state, as illustrated in FIGS. 2A-2B, magnetic attraction between the outer ring magnet 110 and the inner magnet 115 of Connector 1 105 may maintain the inner magnet 115 (and, therefore, the center conductor 114A) in a retracted position 116 relative to a magnetic coupling surface 111 of the outer ring magnet 110 at times the outer ring magnet 110 of Connector 1 105 and the outer ring magnet 160 of Connector 2 155 are not magnetically coupled. It should be understood that, at times the outer ring magnet 110 of Connector 1 105 and the outer ring magnet 160 of Connector 2 155 are not magnetically coupled, magnetic attraction between the outer ring magnet 110 and of Connector 1 105 the inner magnet 115 will cause the midplane 112 of the outer ring magnet 110 and the midplane 117 of the inner magnet 115 to attempt to magnetically align, thereby causing the inner magnet 115 to retract from the magnetic coupling surface 111 of the outer ring magnet 110.

As described above, and as illustrated in FIGS. 1A-1B, magnetic coupling of the outer ring magnet 110 of Connector 1 105 and the outer ring magnet 160 of Connector 2 155 causes a change in the position of magnetic equilibrium for the system (i.e., the magnetic combination of the outer ring magnets 110, 160). In other words, the position of magnetic equilibrium of the system at times the outer ring magnet 110 of Connector 1 105 and the outer ring magnet 160 of Connector 2 155 are not magnetically coupled is at the midplane 112 of the outer ring magnet 110 of Connector 1 105. However, the position of magnetic equilibrium of the system at times the outer ring magnets 110, 160 are magnetically coupled is at the midplane 102 of the magnetic combination of the outer ring magnet 110, 160.

Accordingly, as illustrated in FIGS. 1A-1B, the position of magnetic equilibrium 102 of the magnetic combination of the outer ring magnets 110, 160 may cause the inner magnet 115 to attempt to align its midplane 117 with the midplane 102 of the magnetic combination of the outer ring magnets 110, 160. Therefore, magnetic attraction between the inner magnet 115 of Connector 1 105 and the magnetic combination of the outer ring magnets 110, 160 may maintain the inner magnet 115 in an extended position relative to the retracted position (as described above) at times the outer ring magnets 110, 160 are magnetically coupled. It should be understood that, as illustrated in FIGS. 1A and 2A, the center conductor 164 of Connector 2 155 may be disposed in a position recessed from a magnetic coupling surface 161 of the outer ring magnet 160 of Connector 2 155. Therefore, magnetic attraction between the inner magnet 115 of Connector 1 105 and the combination of the outer ring magnets 110, 160 may maintain the inner magnet 115 of Connector 1 105 in an extended position relative to the magnetic coupling surface 111 of the outer ring magnet 110 at times the outer ring magnets 110, 160 are magnetically coupled.

However, mechanical stops may prevent a full range of motion of inner magnet 115. As illustrated in FIGS. 1A-1B and 2A-2B, a housing 125 may enable a bounded range of motion 130 of the third magnet 115. In certain embodiments, the bounded range of motion 130 maintains the midplane of the inner magnet 115 of Connector 1 105 in a position having a state of magnetic disequilibrium 140 relative to the outer ring magnet 110 of Connector 1 105 at times the outer ring magnets 110, 160 are not magnetically coupled. In the embodiment illustrated in FIGS. 1A and 2B, the first bound may be established via, for example, a body, such as an insulator 120, providing electrical insulation between the outer ring magnet 110 and the inner magnet 115. In this example embodiment, magnetic attraction between the outer ring magnet 110 and the inner magnet 115 may cause the inner magnet to retract to attempt to align its midplane 117 with the midplane 112 of the outer ring magnet 110, thereby causing the insulator 120 to shift along its axis within the housing 125 and a top surface 123 of the insulator 120 to come in contact with an inner surface 127 of the housing 125. The first bound of the bounded range of motion also may be established by a bounding surface 118 of the inner magnet 118 and a bounding surface 122 of the insulator 120.

The bounded range of motion 130 further may comprise a second bound maintaining the midplane of the inner magnet 115 in a position having a second state of magnetic disequilibrium 145 relative the midplane of the magnetically coupled combination of the outer ring magnets 110, 160 at times the outer ring magnets 110, 160 are magnetically coupled. In the embodiment illustrated in FIG. 1A, the second bound may be established via a free range of motion 130 of the insulator 120 in the housing 125. For example, a combination of the housing 125 and the outer ring magnet 110 of Connector 1 105 may bound the free range of motion 130. In other embodiments, the housing 125, alone, may bound the free range of motion 130. It should be understood that the second bound may be established via a use range of motion 135 bounded by a coupling surface 119 of the inner magnet 115 coming in contact with a coupling surface 167 of the center conductor 164 of Connector 2 155. It should be noted that, as illustrated in FIGS. 1A and 2A, the coupling surface 167 of the center conductor 164 of Connector 2 155 may be recessed 166 from the magnetic coupling surface 161 of the outer ring magnet 160 of Connector 2 155, thereby helping to prevent electrical shorting across the outer ring magnet 160 and the center conductor 164 of Connector 2 155. Connector 2 155 also may comprise an electrical insulator 170 disposed between the outer ring magnet 160 and the center conductor 164, and a housing 175.

As illustrated in FIGS. 1A-1B and 2A-2B, and will be shown in greater detail below, the outer ring magnet 160 of Connector 2 155 may be electrically connected to a ground lead 163 to provide electrical grounding for the Connector 1 105. Similarly, a ground lead 113B may be electrically connected to the outer ring magnet 110 of Connector 1 105; therefore, the outer ring magnet 110 of Connector 1 105 may be used as a conductor. Likewise, a positive lead 114B may be connected to the center conductor 114A of Connector 1 105. In alternate embodiments, a spring body 113A may provide electrical ground for Connector 1 105. As will be described in greater detail below, a base insert 181 may be provided for securing Connector 1 105 to an apparatus, and the spring body 113A may provide for automatic alignment of Connector 1 105 and Connector 2 155. Further, a plug 180 may be provided which may be electrically connected to the center conductor 164 of Connector 2 155.

The annular nature of the outer ring magnets 110, 160 causes their magnetic fields to align in such a way that it is energetically unfavorable for the contacts to mate in any way other than concentrically. The effect is heightened with annular geometry because the magnetic fields can travel both around the edges, and through the center core, increasing the alignment tendency compared to disk magnets.

Figure 3B:
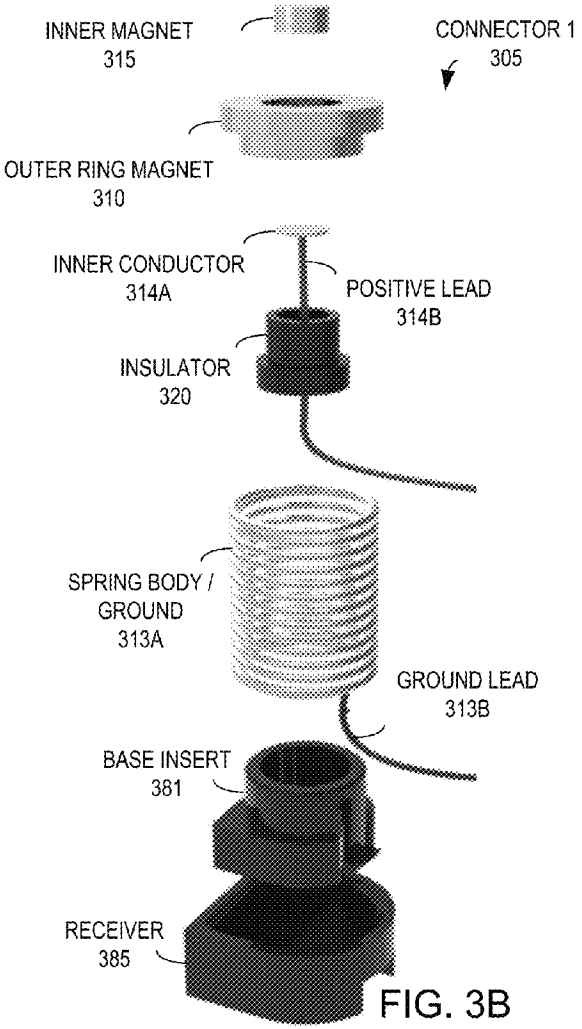
FIGS. 3A-3C are isometric, exploded, and cross-sectional views, respectively, of a first magnetic, self-retracting, auto-aligning electrical connector according to an example embodiment of the present invention.
Figure 3A:
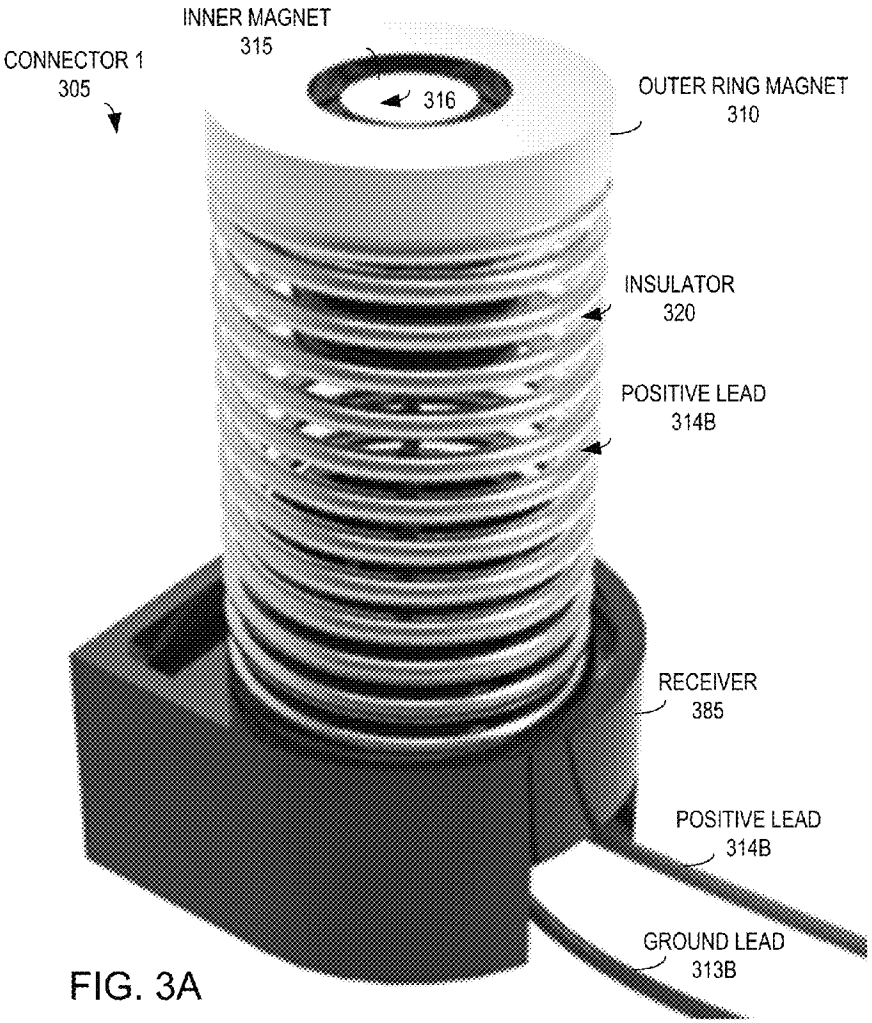
Figure 3C:
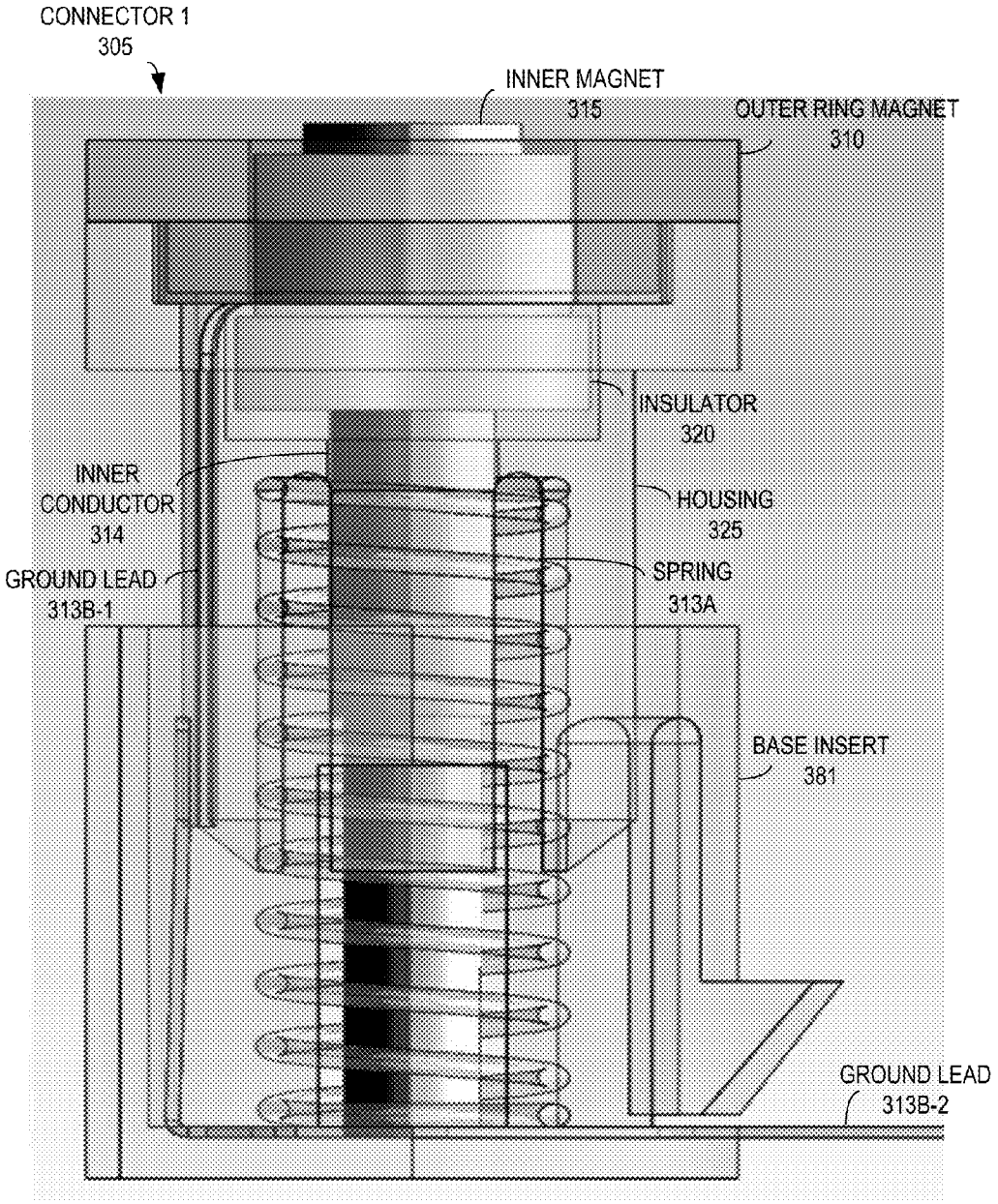

FIGS. 3A-3C are isometric, exploded, and cross-sectional views, respectively, of a first magnetic, self-retracting, auto-aligning electrical connector (Connector 1) 305 according to an example embodiment of the present invention. As illustrated in the example embodiment of FIGS. 3A-3C, Connector 1 305 may comprise an outer ring magnet 310 and an inner magnet 315. The inner magnet 315 may be electrically coupled to an inner conductor 314A which, in turn, may be electrically coupled to a positive lead 314B. An insulator 320 may be disposed between the outer ring magnet 310 and the combination of the inner magnet 315 and the inner conductor 314A to provide electrical insulation between the inner conductor 314A and the outer ring magnet 310. Further, a spring body 313A may be provided to, as described below, allow for automatic alignment of Connector 1 305 with Connector 2 (not shown). In certain embodiments the spring body 313A may be used as an electrical ground and may be electrically coupled to the outer ring magnet 310. A ground lead 313B then may be electrically coupled to the spring body 313A. In other embodiments, such as the embodiment illustrated in FIG. 3C, the ground lead 313B (e.g., ground lead 313B-2) may be electrically coupled to the outer ring magnet 310 (via ground lead 313B-1). The spring body 313A may be coupled to a base insert 381 which may be removeably coupled to a received 385, which may be affixed to an apparatus as described below with respect to FIG. 7. It should be understood that the spring body 313A enables alignment of the outer ring magnets 310, 360 as the magnetic properties of the outer ring magnets 310, 360 will tend to draw their magnetic coupling surfaces into magnetic alignment. Further, it should be noted that, in a preferred embodiment, the spring body 313A does not provide mechanical retracting; rather the combination of the magnets provides the forces.

Figure 4A:
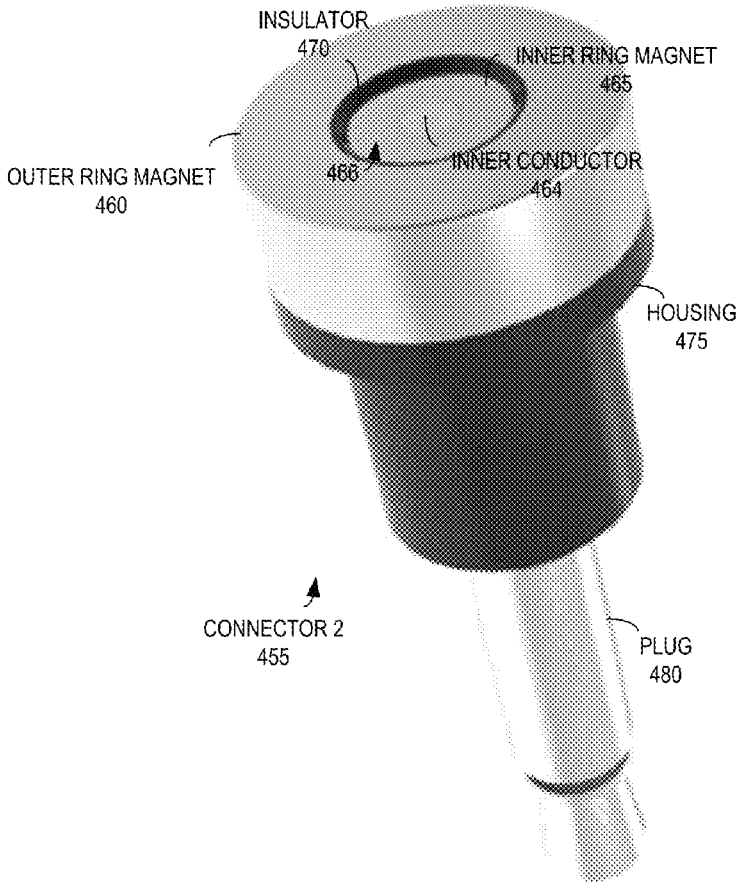
FIGS. 4A-4C are isometric, exploded, and cross-sectional views, respectively, of a second magnetic, self-retracting, auto-aligning electrical connector according to an example embodiment of the present invention.
Figure 4B:
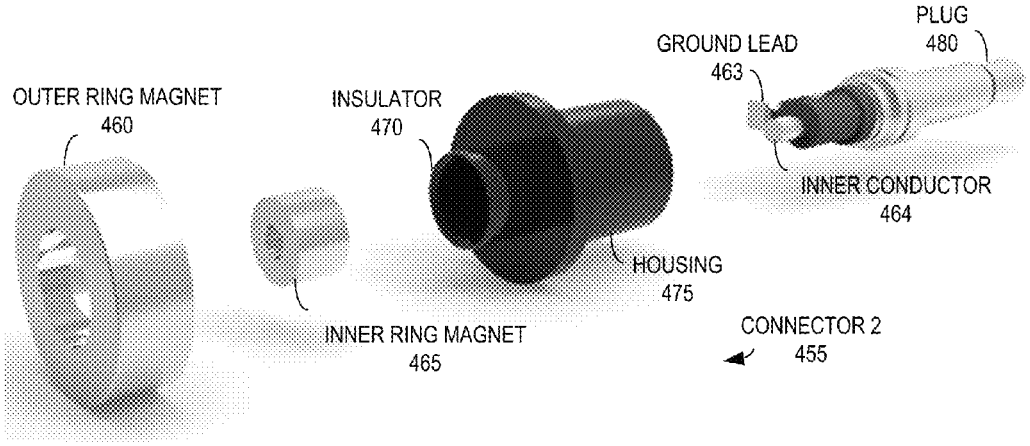
Figure 4C:
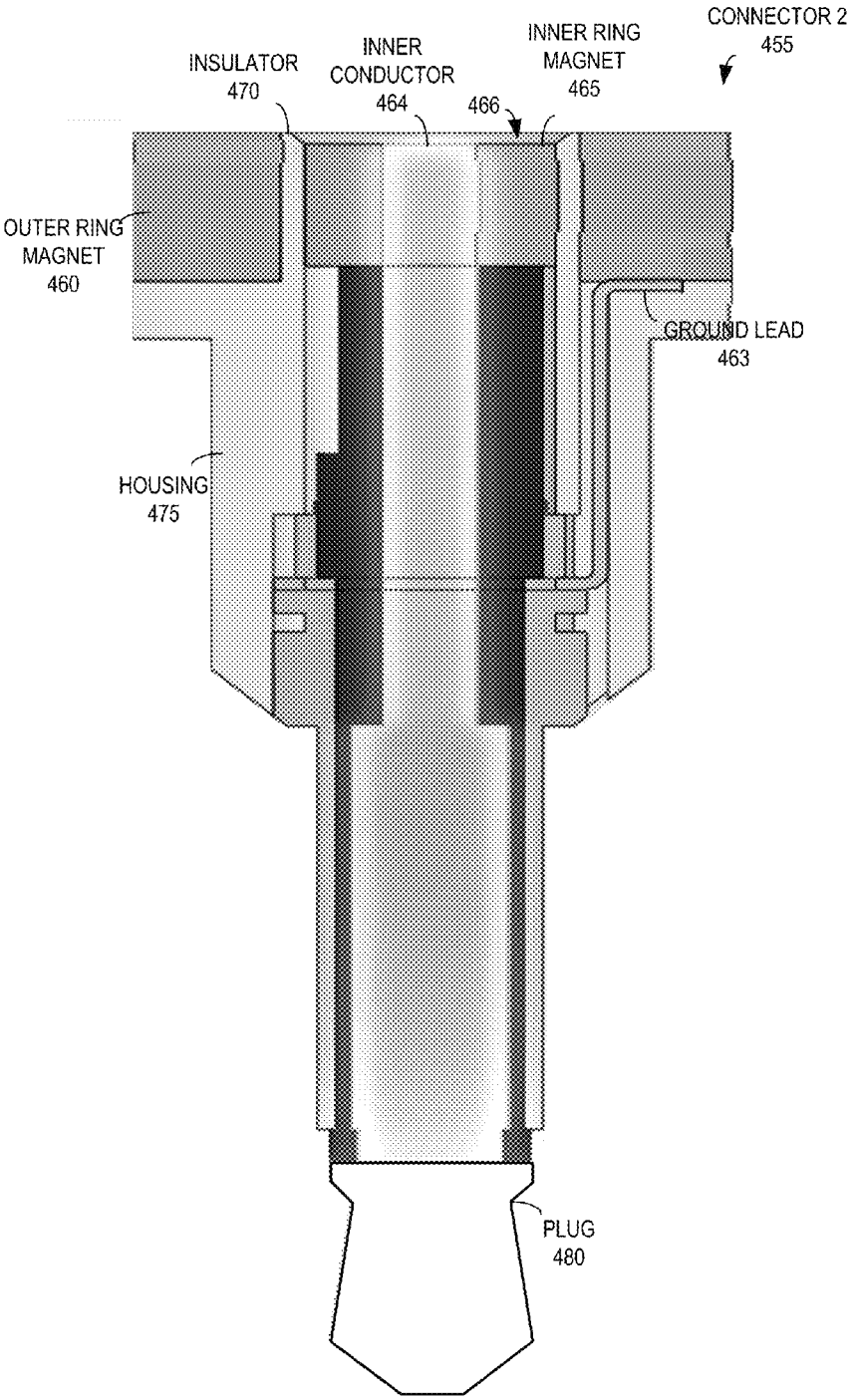

FIGS. 4A-4C are isometric, exploded, and cross-sectional views, respectively, of a second magnetic, self-retracting, auto-aligning electrical connector (Connector 2) 455 according to an example embodiment of the present invention. As illustrated in the example embodiment of FIGS. 4A-4C, Connector 2 455 comprises an outer ring magnet 460 and an inner ring magnet 465. The inner ring magnet 465 may be electrically coupled to an inner conductor 464 which may, in turn, be electrically coupled (not shown) to a plug 480. An insulator 470 may be disposed between the outer ring magnet 460 and the combination of the inner ring magnet 465 and the inner conductor 464 to provide electrical insulation between the inner conductor 464 and the outer ring magnet 460. Further, a ground lead 463 may be provided to provide electrical grounding from the outer ring magnet 465. It should be noted that Connector 2 455 may be part of a device, such as a laptop computer or other electrical equipment, or a separate connector device that may be connected to a preexisting electrical connector to provide the capabilities of the present invention.

Figure 5B:
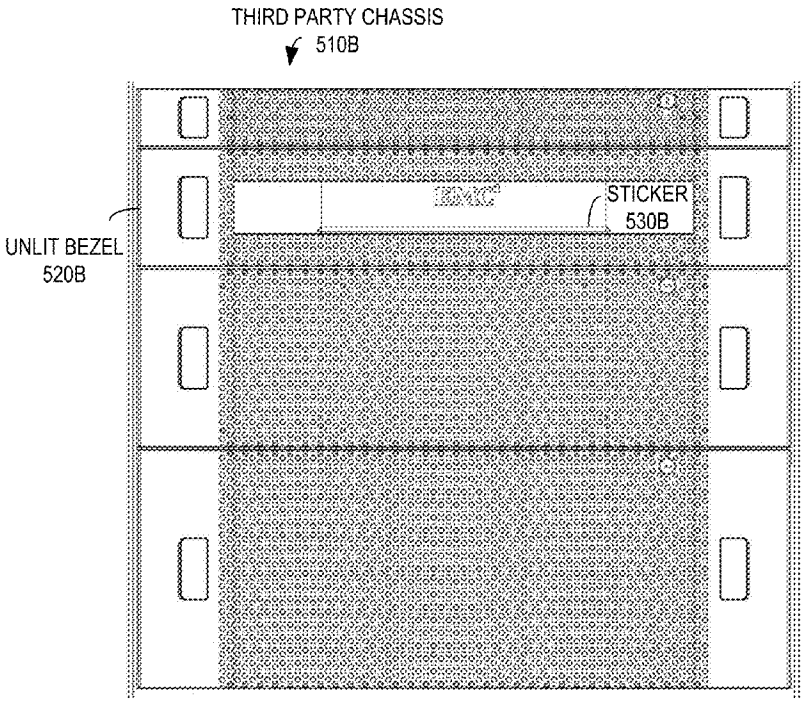
FIG. 5B is a view of a third party chassis including an unlit bezel with a sticker.
Figure 5A:
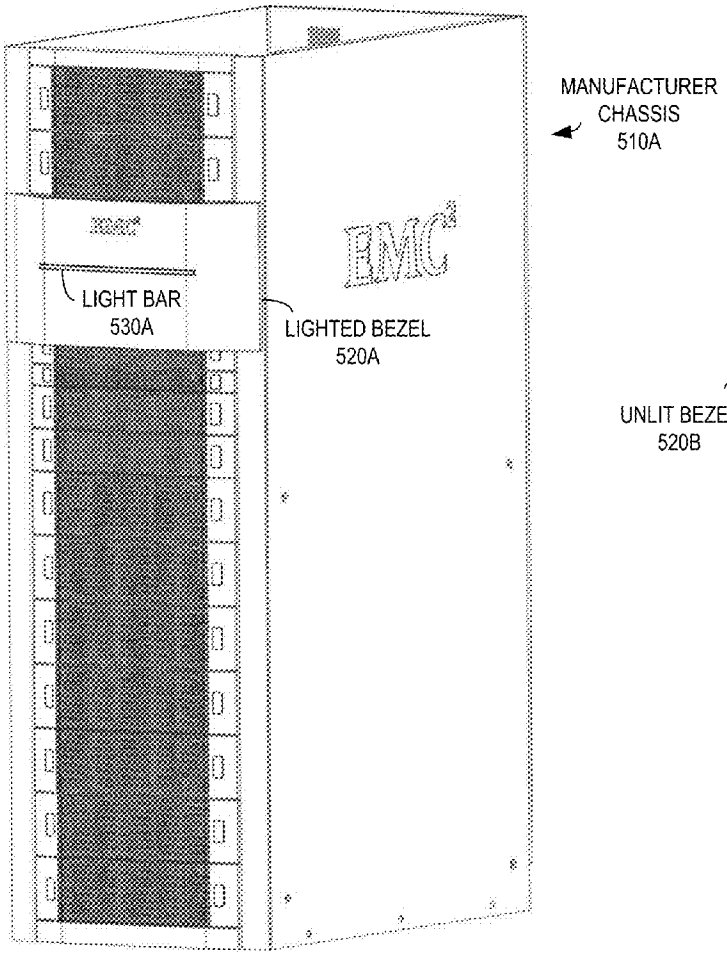
FIG. 5A is an isometric view of a manufacturer chassis including a lighted bezel with a light bar.

FIG. 5A is an isometric view of a manufacturer chassis 510A including a lighted bezel 520A with a light bar 530A. The manufacturer chassis 510A illustrated in FIG. 5A may be from EMC Corporation of Hopkinton, Mass. The manufacturing processes for the chassis are under the control of the manufacturer; therefore, the manufacturer is able to design the chassis 510A in such a way that it is possible to provide electrical power from the manufacturer chassis 510A to the lighted bezel 520A to illuminate the light bar 530A.

FIG. 5B is a view of a third party chassis 510B including an unlit bezel 520B with a sticker 530B. A manufacturer, such as EMC Corporation of Hopkinton, Mass., may provide a product for installation in the third party chassis 510B. However, because control over the manufacture and design of the third party chassis 510B does not rest in the manufacturer (e.g., EMC Corporation), as it does in FIG. 5A, the manufacturer is unable to provide electrical power from the third party chassis 510B to the unlit bezel 520B and is unable to provide a light bar (i.e., light bar 530A of FIG. 5A); rather the manufacturer provides a sticker 530B.

Example embodiments of the present invention may be useful in passing electrical power through small spaces. For example, National Electrical Manufacturers Association (NEMA) compliant racks, which may be used by third parties, have chassis rail holes that are approximately 7 mm in diameter. Example embodiments of the present invention may pass electrical power through the NEMA rack holes without penetrating electro-magnetic interference (EMI) shielding.

Figure 6A:
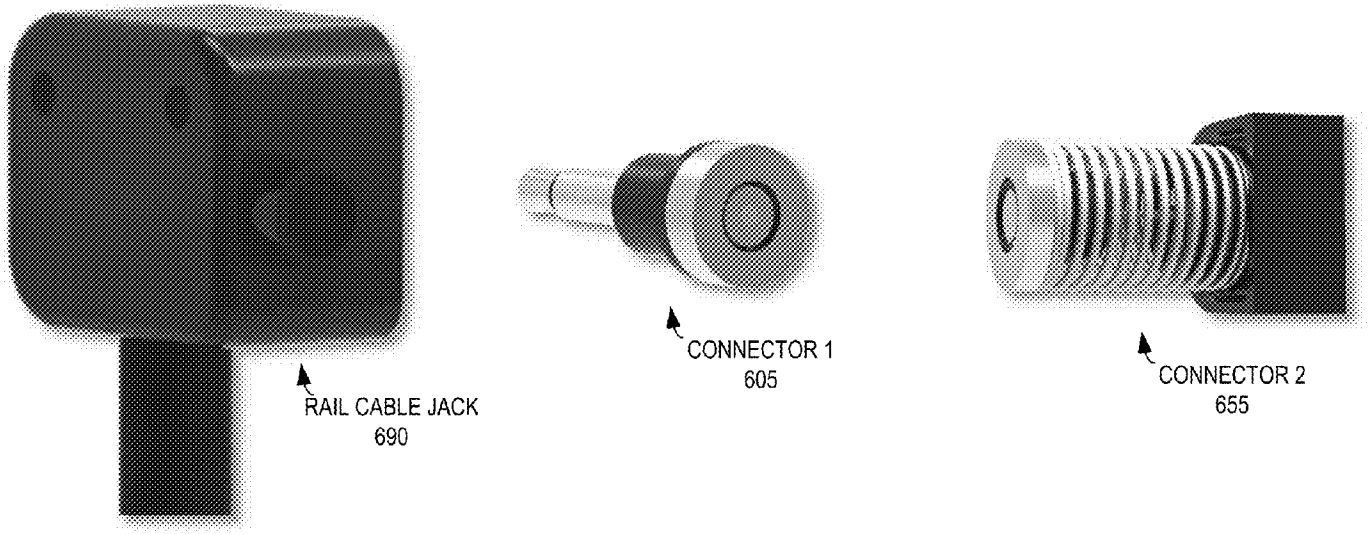
FIG. 6A is an exploded view of a system, including a first magnetic, self-retracting, auto-aligning electrical connector and a second magnetic, self-retracting, auto-aligning electrical connector, according to an example embodiment of the present invention, for connecting to a rail cable jack.

FIG. 6A is an exploded view of a system, including a first magnetic, self-retracting, auto-aligning electrical connector (Connector 1) 605 and a second magnetic, self-retracting, auto-aligning electrical connector (Connector 2) 655, according to an example embodiment of the present invention, for connecting to a rail cable jack 690. As illustrated in FIG. 6A, Connector 1 605 may be electrically and removeably mechanically connected to the rail cable jack 690. Connector 2 655 then may be electrically and magnetically connected to Connector 1 605.

Figure 6B:
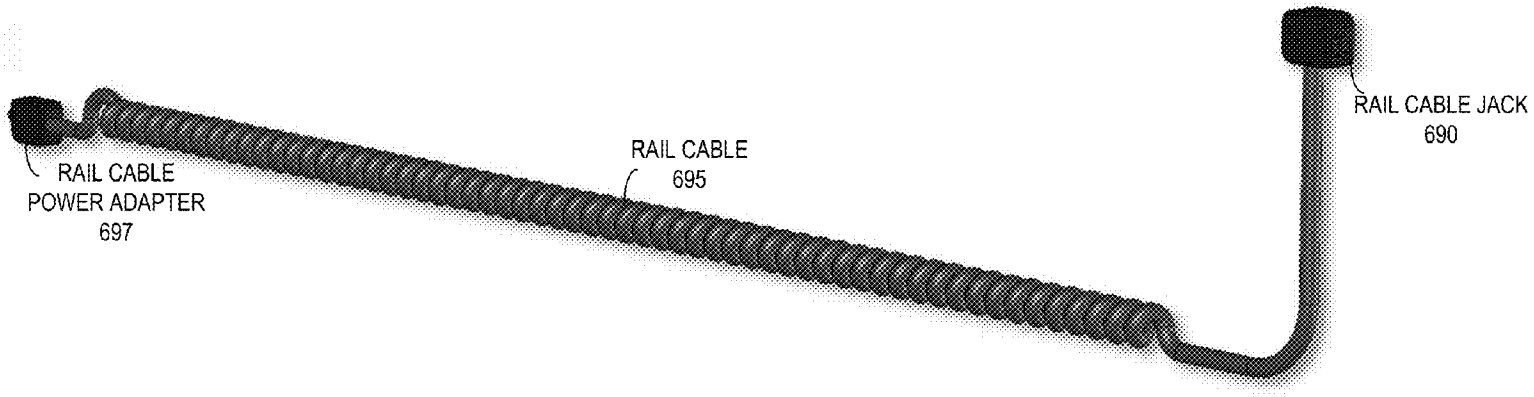
FIG. 6B is an isometric view of a rail cable jack system, comprising a rail cable power adapter, a rail cable, and a rail cable jack.

FIG. 6B is an isometric view of a rail cable jack system, comprising a rail cable power adapter 697, a rail cable 695, and a rail cable jack 690.

Figure 6C:
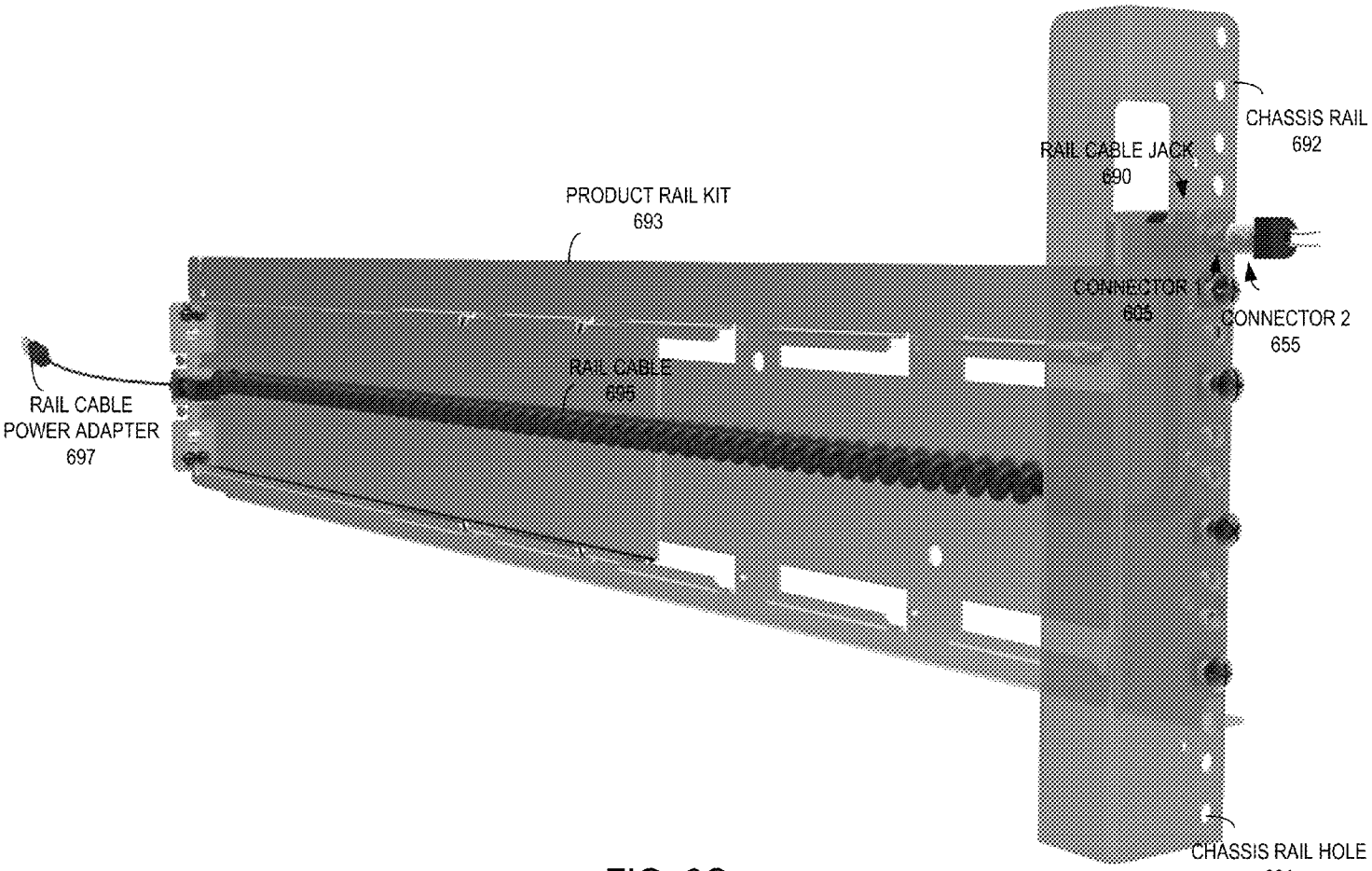
FIG. 6C is an isometric view of a product rail kit mounted to a chassis rail and a rail cable jack system magnetically, mechanically, and electrically connected to a magnetic, self-retracting, auto-aligning electrical connector system according to an example embodiment of the present invention, for passing electrical power through a chassis rail hole.

FIG. 6C is an isometric view of a product rail kit 693 mounted to a chassis rail 692 and a rail cable jack system (i.e., rail cable power adapter 697, rail cable 695, and rail cable jack 690) magnetically, mechanically, and electrically connected to a magnetic, self-retracting, auto-aligning electrical connector system (i.e., Connector 1 605 and Connector 2 655) according to an example embodiment of the present invention, for passing electrical power through a chassis rail hole 694. As illustrated in FIG. 6C, a product rail kit 693, which may come from a manufacturer for installation in a third-party chassis, may be mounted to a chassis rail 692 via provided chassis rail holes 694. A rail cable 695 may be provided along the length of the product rail kit 693 to reach the power connections that may be provided at the rear of the product (not shown) for connection with the rail cable power adapter 697. The opposing end of the rail cable 695, as described above with respect to FIG. 6A, may include a rail cable jack 690, which may be positioned at a rear side of a chassis rail hole 694. Connector 1 605 then may be mechanically and electrically connected through the chassis rail hold 694 to the rail cable jack 690. Connector 2 655 then may be magnetically and electrically connected to Connector 1 605. As will be described below with respect to FIG. 7, Connector 2 655 may be connected to a chassis bezel and the combination of Connector 1 605 and Connector 2 655 enables transmission of power to provide power to a lighted element in the chassis bezel.

Figure 7:
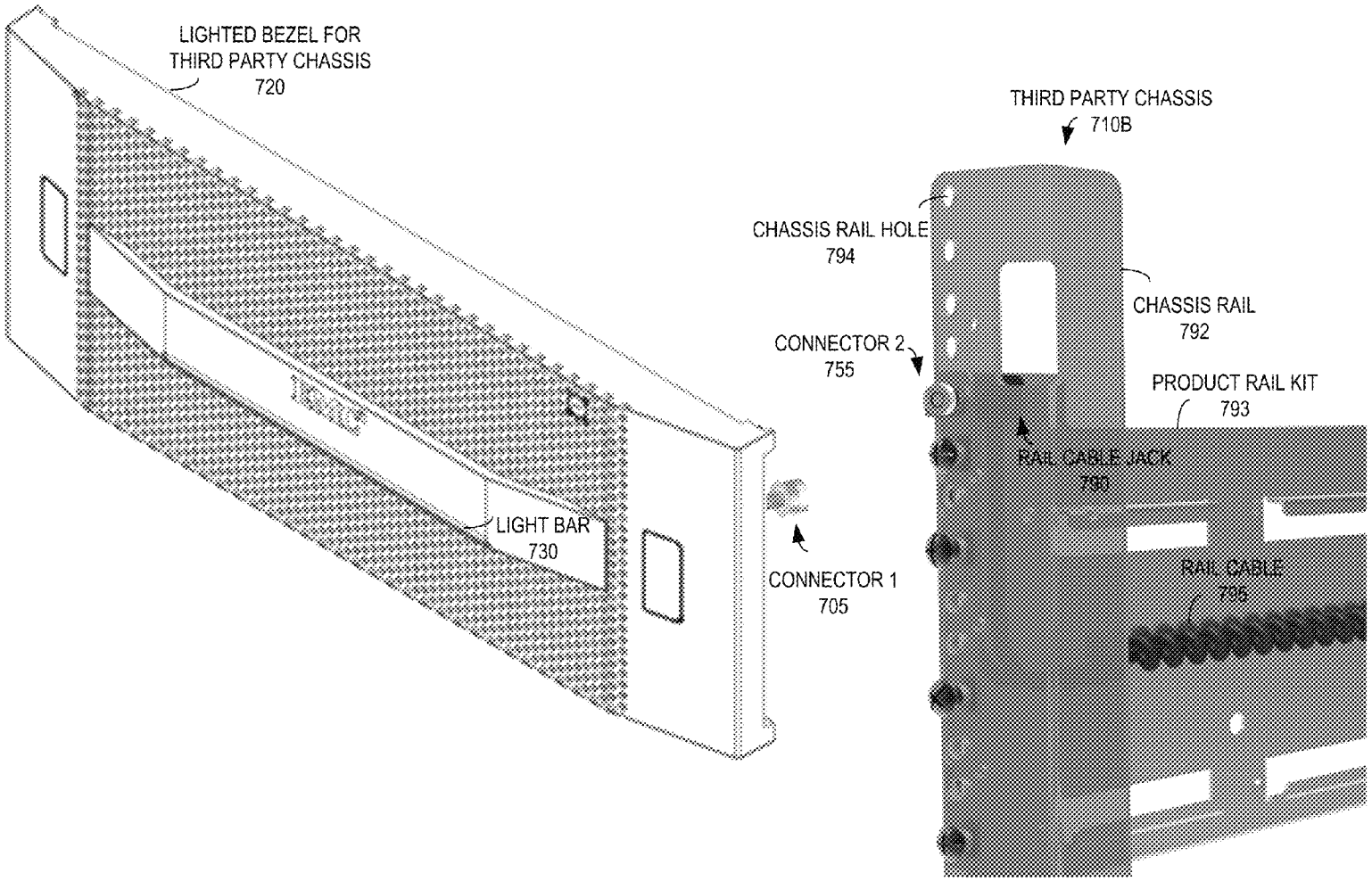
FIG. 7 is an exploded view of a third party chassis and a lighted bezel for a third party chassis configured to pass electrical power through a chassis rail hole via a first magnetic, self-retracting, auto-aligning electrical connector connected to the lighted bezel and a second magnetic, self-retracting, auto-aligning electrical connector connected through the chassis hole to a rail cable jack of a rail cable jack system, according to an example embodiment of the present invention.

FIG. 7 is an exploded view of a third party chassis 710B and a lighted bezel for a third party chassis 720 configured to pass electrical power through a chassis rail hole 794 via a first magnetic, self-retracting, auto-aligning electrical connector (Connector 1) 705 connected to the lighted bezel 720 and a second magnetic, self-retracting, auto-aligning electrical connector (Connector 2) 755 connected through the chassis hole 794 to a rail cable jack 790 of a rail cable jack system, according to an example embodiment of the present invention. In a preferred embodiment, Connector 1 705 (i.e., the connector with the spring) is attached to the bezel (i.e., the unpowered side). Therefore, if the outer ring magnet and/or in the inner conductor contacts something metal, an electrical short may be prevented. In other words, in a preferred embodiment, Connector 2 755 is attached to the powered side as it does not have a spring and is immobile so electrical shorting is less likely. Use of the auto-aligning spring enables the bezel 720 to be removeable and allows for the tolerances of bezel installation with respect to alignment.

It should be understood that, in a preferred embodiment, the force required to magnetically uncouple Connector 1 705 and Connector 2 755 is less than the force required to mechanically uncouple the plug (e.g., plug 180 of FIG. 1A) of Connector 2 755 and the cable rail jack 790, otherwise, the plug may pull out of the cable rail jack 790.

Although the foregoing invention has been described in some detail for purposes of clarity of understanding, it will be apparent that certain changes and modifications may be practiced within the scope of the appended claims. Accordingly, the present implementations are to be considered as illustrative and not restrictive, and the invention is not to be limited to the details given herein, but may be modified within the scope and equivalents of the appended claims.

In reading the above description, persons skilled in the art will realize that there are many apparent variations that can be applied to the methods and systems described. In the foregoing specification, the invention has been described with reference to specific exemplary embodiments thereof. It will, however, be evident that various modifications and changes may be made to the specific exemplary embodiments without departing from the broader spirit and scope of the invention as set forth in the appended claims. Accordingly, the specification and drawings are to be regarded in an illustrative rather than a restrictive sense.

What is claimed is:

1. An apparatus comprising:

a first magnet configured to magnetically couple with a second magnet, and a first conductor configured to be in a first position relative to a first magnetic field of the first magnet at times the first magnet is not magnetically coupled with the second magnet and configured to be in a second position relative to a second magnetic field of a magnetically coupled combination of the first magnet and the second magnet at times the first magnet is magnetically coupled with the second magnet;

wherein magnetic coupling of the first magnet and the second magnet causes a change from the first magnetic field of the first magnet to the second magnetic field of the magnetically coupled combination of the first magnet and the second magnet; and wherein the change from the first magnetic field of the first magnet to the second magnetic field of the magnetically coupled combination of the first magnet and the second magnet causes the first conductor to move from the first position relative to the first magnetic field to the second position relative to the second magnetic field thereby causing electrical coupling of the first conductor and a second conductor.

2. The apparatus of claim 1 wherein the first conductor and the first magnet are disposed coaxially.

3. The apparatus of claim 2 wherein the first conductor is disposed coaxially at a diameter greater than the diameter or the first magnet.

4. The apparatus of claim 2 wherein the first magnet comprises a plurality of first magnets arranged radially with the first conductor.

5. The apparatus of claim 2 wherein the first magnet is a ring magnet disposed coaxially circumferentially around the first conductor.

6. The apparatus of claim 1 wherein the first conductor comprises a third magnet.

7. The apparatus of claim 6 wherein the third magnet has a polarity orientation opposite the polarity orientation of the first magnet.

8. The apparatus of claim 7 wherein magnetic attraction between the first magnet and the third magnet maintains the third magnet in a retracted position relative to a first magnetic coupling surface of the first magnet at times the first magnet and the second magnet are not magnetically coupled.

9. The apparatus of claim 8 wherein magnetic attraction between the third magnet and the combination of the first magnet and the second magnet maintains the third magnet in an extended position relative to the retracted position at times the first magnet and the second magnet are magnetically coupled.

10. The apparatus of claim 8 wherein the second conductor is disposed in a position recessed from a second magnetic coupling surface of the second magnet; and wherein magnetic attraction between the third magnet and the combination of the first magnet and the second magnet maintains the third magnet in an extended position relative to the first magnetic coupling surface at times the first magnet and the second magnet are magnetically coupled.

11. The apparatus of claim 7 further comprising a housing enabling a bounded range of motion of the third magnet, wherein the bounded range of motion comprises a first bound maintaining a center of the third magnet along its axis in a first position of having a first state of magnetic disequilibrium relative to the first magnet at times the first magnet and the second magnet are not magnetically coupled.

12. The apparatus of claim 11 wherein the bounded range of motion further comprises a second bound maintaining the center of the third magnet along its axis in a second position having a second state of magnetic disequilibrium relative a center of the magnetically coupled combination of the first magnet and the second magnet along its axis at times the first magnet and the second magnet are magnetically coupled.

13. The apparatus of claim 1 wherein magnetic coupling of the first magnet and the second magnet further causes automatic alignment of the first conductor and the second conductor.

14. The apparatus of claim 13 further comprising a spring enabling automatic alignment of the first magnet and the second magnet.

15. The apparatus of claim 14 wherein the spring is electrically coupled to the first magnet; and wherein combination of the spring and the first magnet comprises a third conductor.

16. The apparatus of claim 1 wherein the first magnet comprises a third conductor.

17. The apparatus of claim 1 wherein the apparatus is configured to mechanically couple with a connector, wherein a first force required to magnetically uncouple the first magnet and the second magnet is less than a second force required to mechanically uncouple the apparatus connector and the connector.

18. The apparatus of claim 17 wherein the combination of the apparatus and the connector enables transmission of power through rail holes of a chassis to provide power to a lighting element of a chassis bezel.

19. A method of manufacture comprising:

providing a first magnet configured to magnetically couple with a second magnet; and providing a first conductor configured to be in a first position relative to a first magnetic field of the first magnet at times the first magnet is not magnetically coupled with the second magnet and configured to be in a second position relative to a second magnetic field of a magnetically coupled combination of the first magnet and the second magnet at times the first magnet is magnetically coupled with the second magnet;

wherein magnetic coupling of the first magnet and the second magnet causes a change from the first magnetic field of the first magnet to the second magnetic field of the magnetically coupled combination of the first magnet and the second magnet; and wherein the change from the first magnetic field of the first magnet to the second magnetic field of the magnetically coupled combination of the first magnet and the second magnet causes the first conductor to move from the first position relative to the first magnetic field to the second position relative to the second magnetic field thereby causing electrical coupling of the first conductor and a second conductor.

20. A system comprising:

a first connector comprising a first magnet and a first conductor; and a second connector comprising a second magnet and a second conductor;

wherein the first conductor is configured to be in a first position relative to a first magnetic field of the first magnet at times the first magnet is not magnetically coupled with the second magnet and configured to be in a second position relative to a second magnetic field of a magnetically coupled combination of the first magnet and the second magnet at times the first magnet is magnetically coupled with the second magnet;

wherein magnetic coupling of the first magnet and the second magnet causes a change from the first magnetic field of the first magnet to the second magnetic field of the magnetically coupled combination of the first magnet and the second magnet; and wherein the change from the first magnetic field of the first magnet to the second magnetic field of the magnetically coupled combination of the first magnet and the second magnet causes the first conductor to move from the first position relative to the first magnetic field to the second position relative to the second magnetic field thereby causing electrical coupling of the first conductor and the second conductor.

* * * * *